United States Patent [19]

Girty

[11] 4,154,391

[45] May 15, 1979

[54] COMBINED CROP AND LONGEING WHIP

[76] Inventor: Kenneth E. Girty, Dowell Trailer Ct., R.D. #1, Saxonburg, Pa. 16056

[21] Appl. No.: 881,439

[22] Filed: Feb. 27, 1978

[51] Int. Cl.[2] ..... B68B 11/00

[52] U.S. Cl. ..... 231/3; 231/4

[58] Field of Search ..... 231/1, 2 R, 3, 4, 5, 231/6

[56] References Cited

U.S. PATENT DOCUMENTS

| | | | |
|---|---|---|---|
| 815,458 | 3/1906 | Morris | 231/3 |
| 829,392 | 8/1906 | Felker | 231/2 R |
| 1,013,240 | 1/1912 | Towery | 231/3 |
| 1,183,699 | 5/1916 | Tracy | 231/3 |

*Primary Examiner*—Hugh R. Chamblee

*Attorney, Agent, or Firm*—Clarence L. Carlson

[57] ABSTRACT

A device for use during riding and training of animals such as horses which can be utilized either as a riding crop or longeing whip. The body portion of the device defines a crop having a handle formed at one end and a cracker attached to the opposite end. A plurality of flexible wand elements are nested within the body portion and are telescopically extendable from that end to which the cracker is attached. A line defining a lash is attached to the wand element whose axis coincides with that of the body portion and the cracker is fabricated in the form of a closeable pocket. The device forms a longeing whip with the lash and wand elements fully extended and when retracted the lash is retained in coiled form within the closeable pocket thus converting the device to a riding crop.

5 Claims, 4 Drawing Figures

COMBINED CROP AND LONGEING WHIP

BACKGROUND OF THE INVENTION

The invention pertains to a crop and longeing whip which are training devices well known to those conversant in the art of horsemanship and more particularly it relates to a combined crop and longeing whip which can be quickly and easily converted from one to the other.

A crop, as is well known, forms an important part of a rider's attire as well as a training device and a motivating device that is utilized either on the ground or in riding position on his mount.

A rider or trainer by simply applying the cracker portion of the crop to selected areas of the mount's body, is capable of conveying commands to said mount which it has been taught through repetitious training to obey. A few of many such commands are those of stretching, turning, proceeding forwardly and backing up.

A longeing whip is also well known in the art and it to serves as a training and motivating device as well as a means for exercising ones mount. Unlike a crop the intended use of a longeing whip is from the ground and in combination with a socalled longe rein or line with one end thereof being attached to the mount's halter or the like and the opposite end either suitably attached to a fixed object or held by the rider or trainer. The longeing whip is manipulated while giving the mount verbal commands by a flick of said longeing whip below the hocks which serves to reinforce these commands. Additionally appropriate movement of the longeing rein during the longeing session is considered a very important factor in this common form of training.

The longeing whip serves, as described above, to reinforce commands and in many instances to actually convey commands which the mount is trained or is being trained to obey.

Riding crops and longeing whips are common and widely used devices that are considered, by those skilled in the art, as required and necessary implements for the proper care and training of horses.

These devices which serve similar functions of command conveying aids but which are utilized in an entirely different manner have always been manufactured and sold as separate items. Both devices cannot be conveniently carried at the same time and it frequently presents what is considered a valuable loss of time and inconvenience during a training session when it is decided or found feasible to exercise those commands associated with the other of the two devices not in use at the time. Additionally, because of the different functions which these devices serve, both types have always been considered a required part of the standard equipment for the care and training of horses.

The purchase price or replacement cost for both such devices is considered by todays standards excessive and in many instances prohibitive due to the types of materials from which they are frequently fabricated as well as time consuming manufacturing steps of braiding and lacing to provide protective coverings to their exterior surfaces.

The combined crop and longeing whip of the present invention provides a very definite advance in the art for it permits a single training device to be quickly and easily converted from one type to another. It also eliminates the need for maintaining two separate training devices as part of the standard care and training equipment and the expense of purchasing or replacing such devices can now be substantially reduced.

A number of United States patents show and describe training devices in the form of riding crops and whips and for reference to the teachings of such disclosures attention is hereby drawn to U.S. Pat. Nos. 918,557 and 1,893,099.

SUMMARY OF THE INVENTION

The combined crop and longeing whip comprising the invention includes an elongated tapered tubular member with that end of major diameter defining a handle and the opposite end having a cracker attached thereto. A plurality of wand elements are nested within the tubular member and are telescopically extendable through the cracker that is fabricated in the form of a closeable pocket. A line member defining a lash is attached to the end of the wand element whose axis coincides with the axis of the tapered tubular member. The cracker which is in the form of a closeable pocket includes opposed end surfaces defining an opening through which the wand elements are selectively extendable and which in their fully extended position form a longeing whip in combination with the lash. When the wand elements are fully retracted within the tapered tubular member the lash is adapted to be retained in coiled form within the closeable pocket and in this retracted state defines a riding crop.

It is a general object of the invention to provide a training device for horses in the form of a combined crop and longeing whip.

It is a further object of the invention to provide a combined crop and longeing whip training device which can quickly and easily be converted from one type of training device to the other.

A further and more specific object of the invention is to provide a combined crop and longeing whip that is of simplified construction which is relatively inexpensive to manufacture and with long life expectancy.

These and other objects of the invention will become more fully apparent by reference to the appended claims and as the following detailed description proceeds in reference to the figures of drawing wherein:

DESCRIPTION OF THE PREFERRED EMBODIMENT

Figure 1:
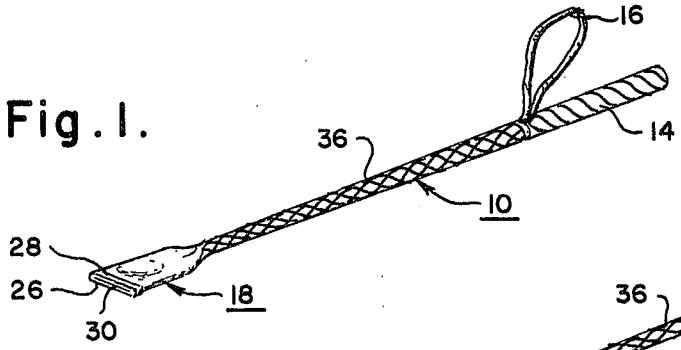
FIG. 1 is a perspective view of the combined crop and longeing whip according to the invention in its retracted form to define a riding crop.
Figure 2:
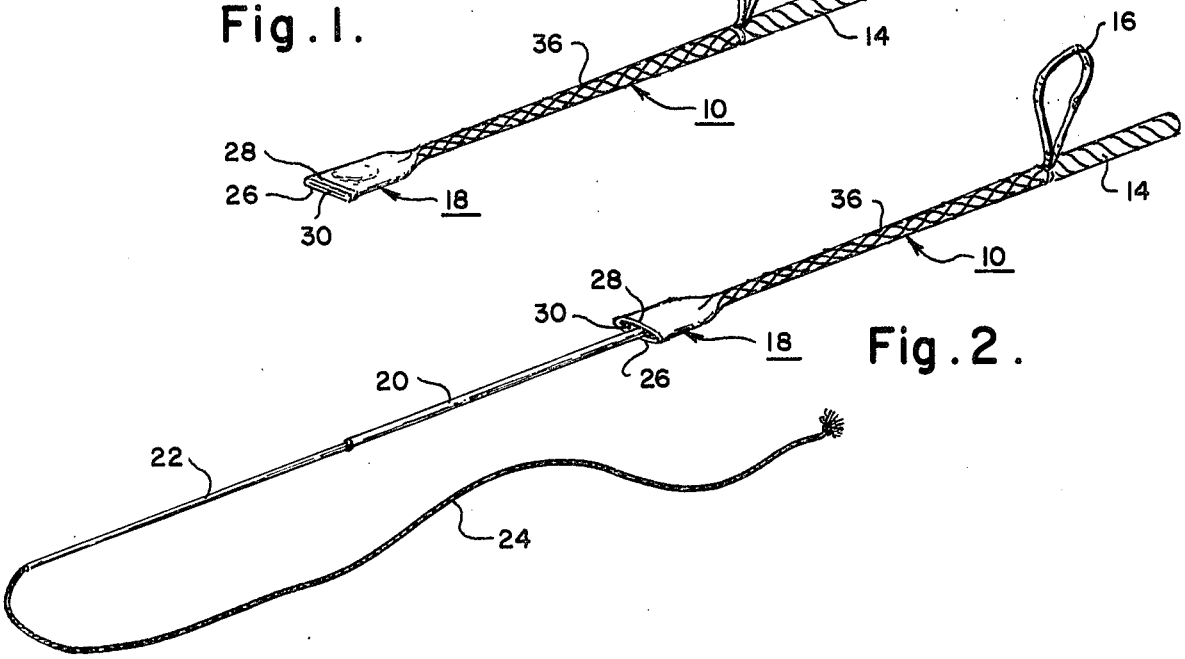
FIG. 2 is a view similar to FIG. 1 showing the elements within the tubular member fully extended to form a longeing whip.
Figure 3:
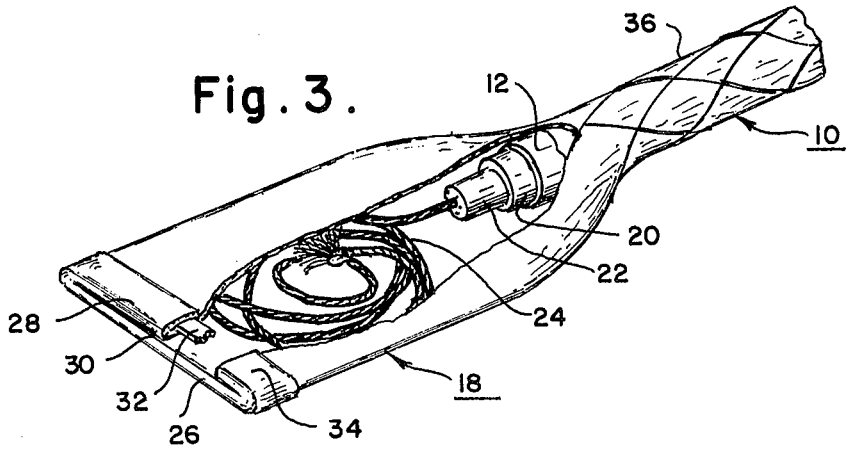
FIG. 3 is a perspective view on an enlarged scale of the cracker end of the combined crop and longeing whip with a portion thereof broken away showing the elements for converting the device to a longeing whip housed therein.

Referring now to the figures of drawing the combined crop and longeing whip according to the invention is identified generally by numeral 10 and includes among its various parts an elongated tapered tubular member 12 (FIG. 3). That end of the tubular member 12 of major diameter defines a handle 14 which extends for a portion of the longitudinal length of said tubular member. A wrist loop 16 is fixedly attached to the handle by any suitable means not shown and is disposed in spaced relation to the free end of said handle (FIGS. 1 and 2).

Figure 4:
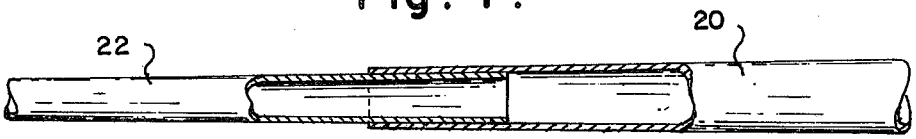
FIG. 4 is a view in side elevation and partially in section showing a portion of the wand elements and their relationship in their extended position.

The end of the tubular member 12 of minor diameter has a cracker assembled thereon which is depicted generally by numeral 18. As shown in FIG. 3, the tubular member 12 has a pair of wand elements 20 and 22 nested therein that are telescopically extendable from that end of said tubular member of minor diameter. These wand elements are also tapered and as shown in FIG. 4 the major diameter of wand element 22 is greater than the minor diameter of wand element 20. The interference fit between these two elements in their extended position maintains them in a locked operating position and without the possibility of one becoming disassembled from the other. Additionally, this interference fit is also provided between the major diameter end of wand element 20 and the minor diameter end of the tubular member 12.

The axis of the wand element 22 coincides with the axis of the tubular member 12 and that end most remote from the handle 14 has one end of a line fixed thereto by any suitable means not shown which defines a lash identified by numeral 24.

The cracker 15 is fabricated in the form of a pocket having opposed end surfaces 26 and 28 which as shown in FIG. 2 defines an opening 30 therebetween which permits the wand elements 20 and 22 to be pulled out to their fully extended position. These wand elements in their retracted position are nested within the tubular member 12 as shown in FIG. 3 and the lash 24 is retained in coiled form within the pocket as is also shown in this figure of drawing.

A closure means is provided for maintaining the opposed end surfaces 26 and 28 in contiguous relation for retaining the lash 24 within the pocket when the device is converted for use as a crop. This closure means includes a depressable blade spring 32 (one only shown in FIG. 3) in operative association with each end surface 26 and 28 and are disposed within a fold 34 that forms an integral part of said end surfaces. These blade springs 32 in their relaxed state are effective in maintaining the opposed end surfaces in contiguous relation and when an inwardly directed force is simultaneously applied to the ends of the blade springs they are deflected away from one another so as to form the opening 30. This opening 30 permits the lash 24 and wand elements which are flexible to be extended as shown in FIG. 2 so as to convert the device into a longeing whip or it will allow the reverse procedure so as to convert the device into a riding crop.

Although the preferred embodiment discloses a blade spring type of pocket closure it should be understood that other forms could serve this purpose such as a Velcro type closure, snaps or zipper.

The pocket 18 is fabricated from flexible sheet material such as leather, vinyl or the like and in the embodiment shown said pocket is provided with integral extensions that have been utilized to form a protective braid covering 36 for that portion of the tubular member 12 intermediate the handle 14 and the cracker 18. It should also be understood that the cracker 18 and protective covering for the tubular member 12 could be formed as separate elements.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

I claim:

1. A combined crop and longeing whip comprising:

(a) an elongated tapered tubular member;

(b) means defining a handle adjacent that end of said tubular member of major diameter;

(c) a plurality of wand elements nested within said tubular member and telescopically extendable from that end of the latter of minor diameter;

(d) a line member defining a lash fixed on one end of one of said wand elements the axis of which coincides with the axis of said tubular member;

(e) pocket means defining a cracker attached to that end of said tubular member of minor diameter including:

(i) opposed end surfaces forming an opening for receiving said line member when said wand elements are retracted within said tubular member; and (ii) closure means for maintaining said opposed end surfaces in contiguous relation for retaining said line within said pocket means.

2. The structure according to claim 1 wherein said means defining a handle includes a wrist loop attached thereto at a location spaced from the end of said tapered tubular member of major diameter.

3. The structure according to claim 1 wherein said wand elements define a first tapered tubular element telescopically assembled within said tubular member and a second tapered element telescopically assembled within said first tubular element with the minor diameter of said tubular member being less than the major diameter of said first tubular element and the major diameter of said second tapered element being greater than the minor diameter of said first tubular element.

4. The structure according to claim 1 wherein said pocket means is fabricated from flexible sheet material for effecting selective opening and closing thereof.

5. The structure according to claim 1 wherein said closure means defines a depressable blade spring operatively associated with each of said opposed end surfaces which in their relaxed state maintain said surfaces in contiguous relation and in their depressed state effects the separation thereof.

* * * * *